US005097762A

United States Patent [19]

Nakano et al.

[11] Patent Number: 5,097,762

[45] Date of Patent: Mar. 24, 1992

[54] KEYLESS PRINTING PRESS

[75] Inventors: Takafumi Nakano; Akikazu Seo, both of Mihara; Hiromitsu Soeda; Masataka Hirota, both of Hiroshima, all of Japan

[73] Assignees: Mitsubishi Jukogyo Kabushiki Kaisha, Tokyo; Ryomei Engineering Co., Ltd., Hiroshima, both of Japan

[21] Appl. No.: 397,651

[22] Filed: Aug. 23, 1989

[30] Foreign Application Priority Data

Aug. 25, 1988 [JP] Japan ..... 63-110582[U]

[51] Int. Cl.[5] ..... B41F 9/10

[52] U.S. Cl. ..... 101/157; 101/169

[58] Field of Search ..... 101/157, 348; 400/169

[56] References Cited

U.S. PATENT DOCUMENTS 4,590,855 5/1986 Schommer et al. ..... 101/157
4,602,564 7/1986 Sakamoto et al. ..... 101/350
4,864,925 9/1989 Van Kenegan et al. ..... 101/350

FOREIGN PATENT DOCUMENTS 064270 10/1982 European Pat. Off. .
8401569 7/1988 Fed. Rep. of Germany .

*Primary Examiner*—Edgar S. Burr
*Assistant Examiner*—John S. Hilten
*Attorney, Agent, or Firm*—Wenderoth, Lind & Ponack

[57] ABSTRACT

The known keyless printing press including an ink feeder section consisting of an ink source roller, a transfer roller, a doctor roller, an anti-hysteresis doctor disposed on the circumferential surface of the doctor roller and the like, and also provided with a wetting device for a plate drum, is improved in order to realize a fresh condition of the ink source roller which is free from residual ink before printing ink having a uniform moisture content is applied thereto. The improvements reside in that a refresh doctor is disposed on the ink source roller at a position downstream of the nip between the ink source roller and the transfer roller for scraping residual ink from the circumferential surface of the ink source roller.

6 Claims, 5 Drawing Sheets

KEYLESS PRINTING PRESS

BACKGROUND OF THE INVENTION

1. Field of the Invention

The present invention relates to a keyless printing press including an ink feeder section consisting of an ink source roller, a transfer roller, a doctor roller, an anti-hysteresis doctor disposed on the circumferential surface of the doctor roller, and the like, and also provided with a wetting device. A keyless printing press refers to a printing press in which ink keys provided in a doctor of an ink source roller are omitted.

2. Description of the Prior Art

One example of the above-mentioned keyless printing press in the prior art is shown in FIG. 5. In this figure, ink b within an ink reservoir 1 associated with an ink feed port 17 is sent under pressure through a suction pipe 2 and a delivery pipe 4 to an ink delivery nozzle 5 by means of a pump 3. The ink delivery nozzle 5 is disposed in opposition to and in parallel with the circumferential surface of the ink source roller 7 with a minute gap defined therebetween. The ink delivery nozzle 5 is provided with a large number of delivery holes aligned in the axial direction of the ink source roller 7. The ink delivered from the ink delivery nozzle 5 and adhered to the ink source roller 7 rotates jointly with the ink source roller 7 rotating at a low speed, and is metered into a predetermined thickness by passing through the minute gap defined between the ink source roller 7 and an ink feed doctor 6 disposed in parallel to the former. Surplus ink $b_1$ is returned by the ink feed doctor 6 to the ink reservoir 1, while the ink having passed through the minute gap is transferred to a transfer roller 8 rotating at a high speed in contact with the ink source roller 7. Then, the transferred ink is fed to a plate drum 14 by the intermediary of a doctor roller 9 having an ink film of uniform thickness formed thereon by an anti-hysteresis doctor 10, and ink application rollers 11 and 12.

On the other hand, wetting water c is fed from a wetting device 13 to the plate drum 14. Thus, on the plate drum 14, ink adheres to a pattern portion while wetting water c adheres to a non-pattern portion, whereby a predetermined ink film image is formed. This ink film image is transferred via a blanket drum 15 to a paper sheet a.

In the above-described keyless printing press in the prior art, since ink $b_2$ adhered to the doctor roller 9 and containing the wetting water c is scraped by the anti-hysteresis doctor 10 and is made to drop into the ink reservoir 1, the ink b delivered from the ink delivery nozzle 5 to the ink source roller 7 and adhering thereto contains 10–30% of wetting water c, and also, a part of the wetting water c flows inversely to the ink source roller 7 via the doctor roller 9 and the transfer roller 8.

Moreover, the proportion of water in the ink film transferred from the ink source roller 7 rotating at a low speed to the transfer roller 8 rotating at a high speed is unstable. And, in the case where the moisture content proportion of ink is high, the proportion of water is uneven along the width of the roller. Hence, the moisture content of residual ink on the ink source roller after passing through a nip between the ink source roller 7 and the transfer roller 8 is also uneven along the width of the ink source roller 7. Thus even if fresh ink having a uniform moisture content were fed into the residual ink, the unevenness of the moisture content of the ink film on the ink source roller 7 would be mitigated only a little, but the moisture content cannot be uniform. Accordingly, there exists a problem in that a difference arises in the proportion of ink or the amount of ink along the width of the roller, resulting in an uneven printing depth along the width of the roller.

SUMMARY OF THE INVENTION

The present invention has been developed in order to deal with the aforementioned problem in the prior art, and it is one object of the present invention to provide a novel keyless printing press in which ink feed performance and reliability are improved and printing quality is enhanced.

According to one feature of the present invention, there is provided a keyless printing press including an ink feeder section consisting of an ink source roller, a transfer roller and a doctor roller rotating in contact with one another and on the circumferential surfaces of which printing ink delivered from an ink delivery nozzle adheres and is subsequently transferred, an anti-hysteresis doctor for scraping off surplus ink adhered to the circumferential surface of the doctor roller, and the like, and a wetting device. A refresh doctor is disposed on the ink source roller at a position downstream of the nip between the ink source roller and the transfer roller for scraping residual ink from the circumferential surface of the ink source roller. The ink adhering to, rotating with and transferred by the ink source roller can be made to consist of only new fresh ink by scraping the residual ink at the position downstream of the nip between the ink source roller and the transfer roller by means of the refresh doctor engaged with the ink source roller. Thus, the unevenness in the moisture content of ink along the width of the roller, that is, differences in the proportion or amount of the ink along the width of the roller can be effectively eliminated.

During operation of the ink feeder section in the keyless printing press according to the present invention, residual ink on the circumferential surface of the ink source roller is scraped by the refresh doctor engaged with the ink source roller at a position downstream of the nip between the ink source roller and the transfer roller. Hence, the ink adhering to, rotating with and transferred by the ink source roller is only new fresh ink delivered from the ink delivery nozzle. Thus, unevenness in the moisture content along the width of the roller is eliminated, differences in the proportion of ink or the amount of ink along the width disappear, and a printing depth can be equalized.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Figure 1:
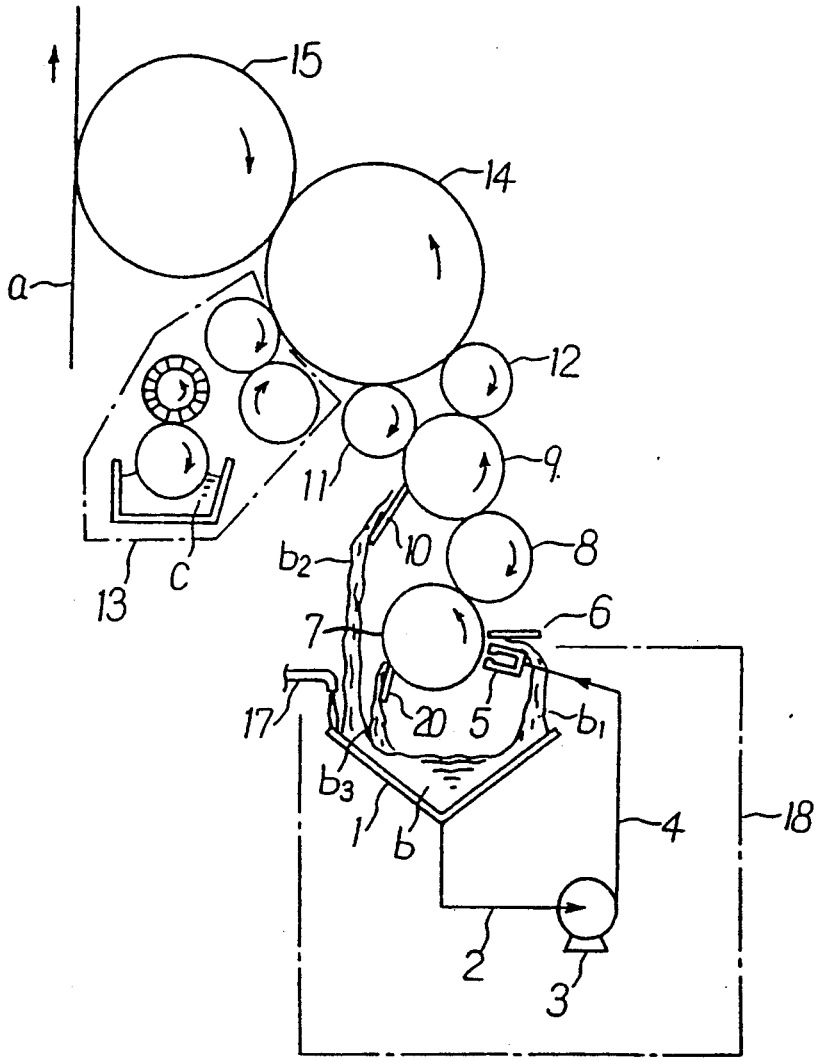
FIG. 1 is a schematic side view of a first preferred embodiment of the present invention.
Figure 2:
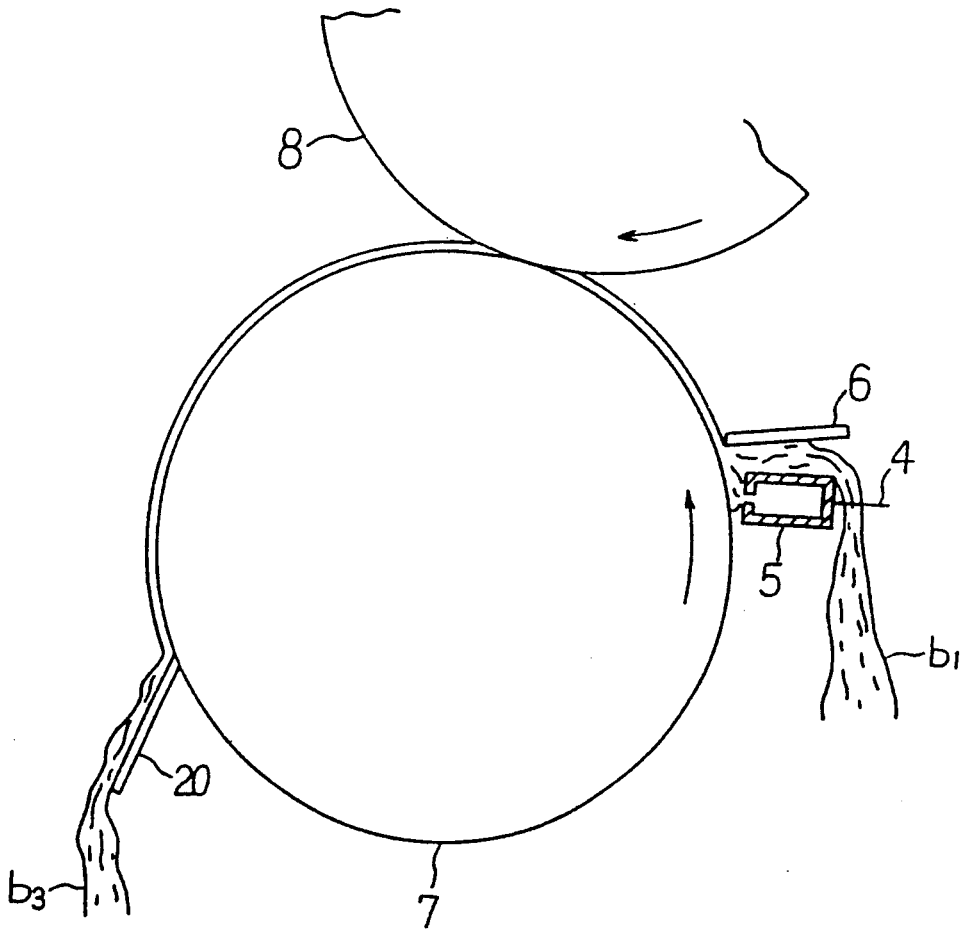
FIG. 2 is a partial enlarged view of an essential part of the device shown schematically in FIG. 1.

Now a first preferred embodiment of the present invention illustrated will be described with reference to FIGS. 1 and 2. In these figures, printing ink b within an ink reservoir 1 provided with an ink feed port 17 is sent under pressure to an ink delivery nozzle 5 through a suction pipe 2 and a delivery pipe 4 by means of a pump 3. The printing ink is delivered to an ink source roller 7 through the ink delivery nozzle 5, which is disposed in parallel to and in opposition to a circumferential outer surface of the ink source roller 7 with a minute gap defined therebetween. The delivery nozzle 5 is provided with a large number of delivery holes disposed along the axial direction of the ink source roller 7. The ink adheres to the roller 7 and rotates jointly with the roller, and the ink adhered to the ink source roller 7 is metered into a predetermined thickness by an ink feed doctor 6 which is disposed in parallel to the ink source roller with a minute gap defined therebetween. Surplus ink $b_1$ is returned into the ink reservoir 1. In addition surplus ink $b_2$ containing wetting water on a doctor roller 9 is scraped out by an anti-hysteresis doctor 10 and drops into the ink reservoir. The above-mentioned component elements constitute an ink circulation system 18 encircled by a dash-dot line. In addition, the illustrated keyless printing press comprises an ink feeder section consisting of the ink source roller 7, a transfer roller 8 and the doctor roller 9 rotating in contact with one another and on the circumferential surfaces of which rollers printing ink delivered from the ink delivery nozzle 5 adheres and is sequentially transferred, and an anti-hysteresis doctor 10 for scraping off surplus ink $b_2$ adhered to the circumferential surface of the doctor roller 9. Furthermore, ink application rollers 11 and 12, a plate drum 14 and a blanket drum 15 are provided in succession to the doctor roller 9. A wetting device 13 is also provided.

Still further, in the illustrated keyless printing press embodying the present invention, there is provided a refresh doctor 20 which is disposed in contact with the ink source roller 7 at a position downstream of the nip between the ink source roller 7 and the transfer roller 8 and upstream of the ink delivery nozzle 5, i.e. between the location at which said ink source roller 7 contacts said transfer roller 8 and the location at which the ink source roller 7 is sprayed with ink directed by ink delivery nozzle 5. Therefore, refresh doctor 20 scrapes residual ink $b_3$ from the circumferential surface of the ink source roller 7.

Next, the operation of the keyless printing press according to the first preferred embodiment of the present invention, which has the above-described structure shown in FIG. 1, will be described in detail. In the ink feeder section, the residual ink on the ink source roller 7 after passing through a nip portion, that is, the location at which the ink source roller 7 contacts the transfer roller 8, has a high moisture content and the moisture content is not uniform along the width of the ink source roller 7 due to the fact that a part of the wetting water c fed from the wetting device tends to flow inversely via the doctor roller 9 and the transfer roller 8. Even if fresh ink having a constant and uniform moisture content were fed from the ink delivery nozzle 5 into the residual ink, the moisture content of the resultant ink film would not become uniform along the width of the ink source roller 7, and a difference would arise in the proportion of ink or the amount of ink along the width of the roller and thus transferred by the roller. However, in the illustrated embodiment, since the above-mentioned residual ink is completely scraped off of roller 7 and caused to drop into the ink reservoir 1 by means of the refresh doctor 20 disposed on the ink source roller 7, the ink newly made to adhere to the ink source roller 7 is only that delivered from the ink delivery nozzle 5. Hence, even if the surplus ink $b_1$ containing the wetting water c which is sent from the feed doctor 6, the surplus ink $b_2$ sent from the anti-hysteresis doctor 10 and the residual ink $b_3$ sent from the refresh doctor 20 are added to the ink within the ink reservoir 1, as a result of the mixing thereof within the ink reservoir 1, the conveyance thereof under pressure through the suction pipe 2 and the delivery pipe 4 by the pump 3 and the delivery thereof by the ink delivery nozzle 5, the ink newly delivered from the ink delivery nozzle 5 adheres to the ink source roller 7 as fresh ink having a constant and uniform moisture content. Thus, the moisture content of the ink film adhering to the ink source roller 7 becomes uniform along the width of the roller. Accordingly a difference in the proportion of ink or the amount of ink along the width of roller 7 is eliminated, a printing depth is equalized, and printing performance and reliability are remarkably improved.

Figure 3:
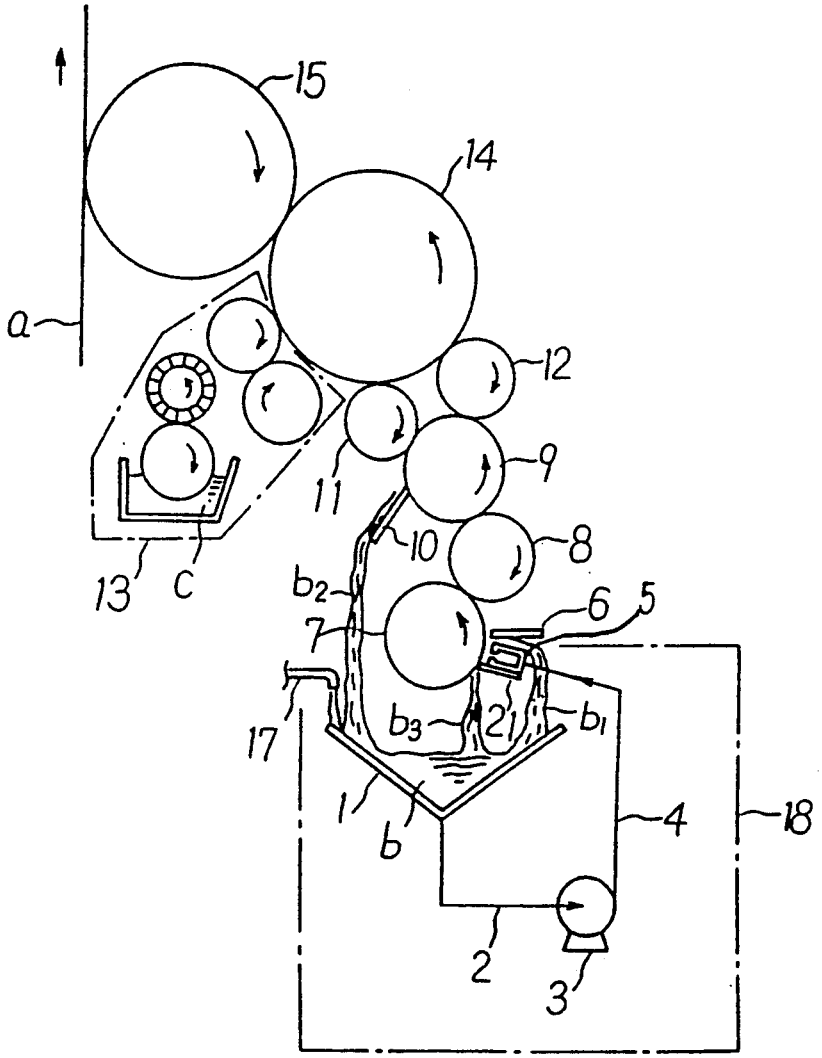
FIG. 3 is a schematic side view of a second preferred embodiment of the present invention.

A second preferred embodiment of the present invention is illustrated in FIG. 3. As compared to the first preferred embodiment described above, this second preferred embodiment is characterized in that a refresh doctor 21 is disposed on the underside of the ink delivery nozzle 5 as viewed in FIG. 3, that is, immediately upstream of the ink delivery nozzle 5 with respect to the direction of rotation of the ink source roller 7. Otherwise, the second preferred embodiment is similar to the first preferred embodiment and hence like functions and effects are provided.

Figure 4:
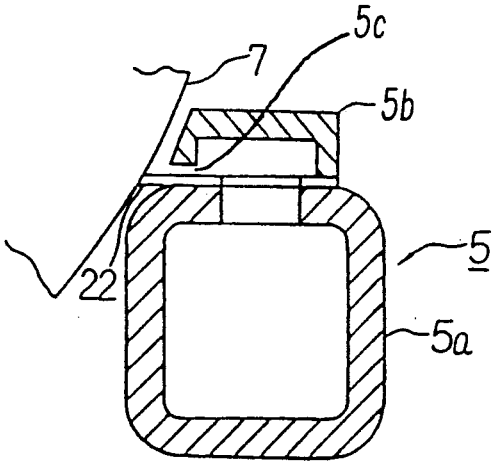
FIG. 4 is a partial enlarged view of an essential part of a keyless printing press in a third preferred embodiment of the present invention.
Figure 5:
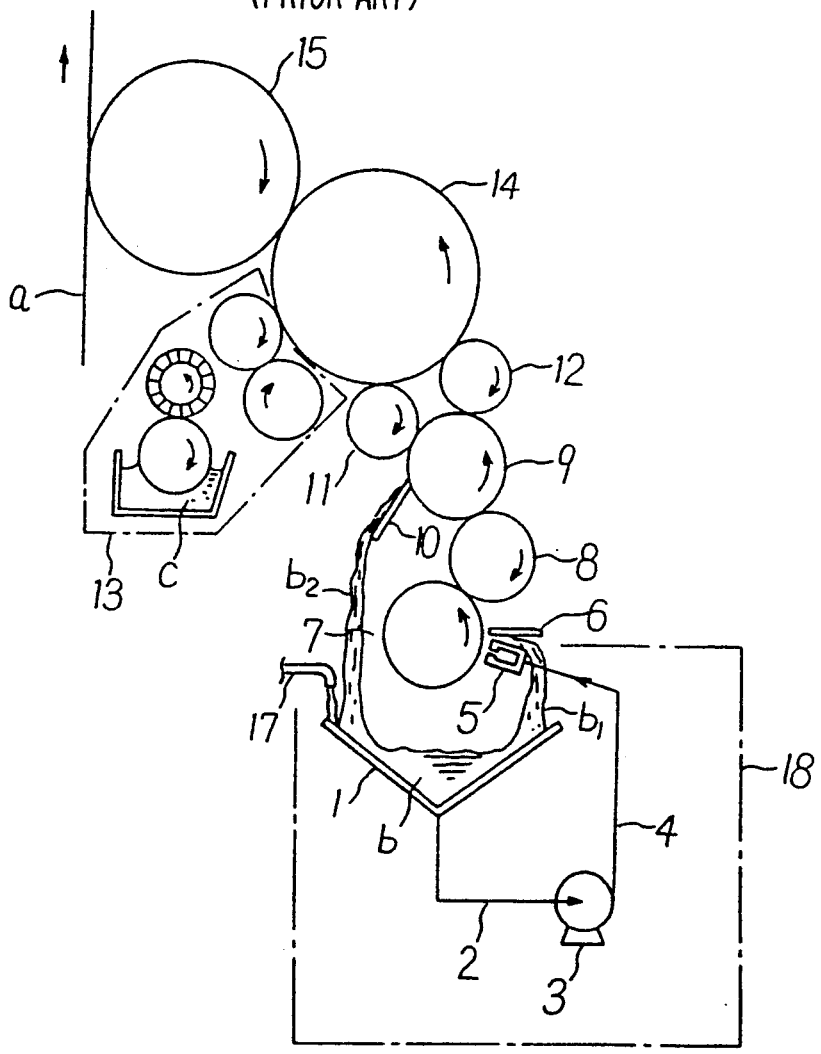
FIG. 5 (PRIOR ART)
FIG. 5 is a schematic side view of a keyless printing press in the prior art.

Alternatively, in a third preferred embodiment of the present invention illustrated in FIG. 4, a refresh doctor 22 is disposed on a main body 5*a*. of an ink delivery nozzle 5 with the refresh doctor 22 held in contact with the ink source roller. An ink delivery portion 5*c* is formed by a cap 5*b* on the main body 5*a*. Thus, the refresh doctor is disposed immediately upstream of the ink delivery port 5*c* with respect to the direction of rotation of the ink source roller 7 (at the bottom of the ink delivery port 5*c*), and new ink is delivered from the ink delivery port 5*c* so as to adhere to the ink source roller 7. In such a modified embodiment the same basic functions and effects as in the above embodiments can be provided.

As described in detail above, since the keyless printing press is constructed in the above-described manner, in the ink feeder section of the keyless printing press residual ink having a non-uniform moisture content on the ink source roller after passing through the gap between the ink source roller and the transfer roller is scraped by the refresh doctor. Hence, the ink adhering to the ink source roller, rotating jointly with and being transferred by the roller consists of only ink having a uniform moisture content which has been delivered from the ink delivery nozzle. Thus, a difference in the proportion of ink or the amount of ink as taken along the width of the roller is eliminated, a printing depth is equalized, and ink feeding performance, reliability, and printing quality are remarkably improved.

While a principle of the present invention has been described above in connection with preferred embodiments of the invention, it is a matter of course that many apparently widely different embodiments of the present invention can be made without departing from the spirit of the invention.

We claim:

1. A keyless printing press comprising an ink feeder section having an ink source roller, a transfer roller and a doctor roller rotatably supported in the press in contact with one another for sequentially transferring ink along the circumferential outer surfaces thereof, an ink delivery nozzle opposite said ink source roller for directing a spray of ink over the width of said ink source roller at a location at the circumferential outer surface of said ink source roller, an anti-hysteresis doctor engaging said doctor roller for scraping surplus ink from the circumferential outer surface of the doctor roller, a wetting device in operative association with said doctor roller for supplying wetting water to the doctor roller, and a refresh doctor engaging said ink source roller over the width thereof at a location, as taken in the direction of rotation of the ink source roller in the press, between the location at which said ink source roller contacts and transfer roller and the location at which said ink source roller is sprayed with ink directed by said ink delivery nozzle for scraping residual ink from the circumferential outer surface of said ink source roller over the width thereof.

2. A keyless printing press as claimed in claim 1, wherein said refresh doctor is disposed immediately upstream of said ink delivery nozzle with respect to the direction of rotation of said ink source roller in the press.

3. A keyless printing press as claimed in claim 1, wherein said ink delivery nozzle defines an ink delivery port therein through which ink is discharged from the nozzle toward said ink source roller, and said refresh doctor is disposed immediately upstream of said ink delivery port with respect to the direction of rotation of said ink source roller in the press.

4. In a keyless printing press including an ink feeder section having an ink source roller, a transfer roller and a doctor roller rotatably supported in the press in contact with one another for sequentially transferring ink along the circumferential surfaces thereof, an ink delivery nozzle opposite and ink source roller for directing a spray of ink over the width of the ink source roller at a location at the circumferential outer surface of the ink source roller, an anti-hysteresis doctor engaging the doctor roller for scraping surplus ink from the circumferential outer surface of the doctor roller, and a wetting device in operative association with the doctor roller for supplying wetting water to the doctor roller, the improvement comprising a refresh doctor engaging said ink source roller over the width thereof at a location between, as taken in the direction of rotation of the ink source roller in the press, the location at which said ink source roller in the press, the location at which said ink source roller contacts said transfer roller and the location at which said ink source roller is sprayed with ink directed by said ink delivery nozzle for scraping residual ink from the circumferential outer surface of said ink source roller over the width thereof so as to prevent differences in the proportion or amount of ink from arising along the width of said ink transfer roller.

5. The improvement in a keyless printing press as claimed in claim 4, wherein said refresh doctor is disposed immediately upstream of said ink delivery nozzle with respect to the direction of rotation of said ink source roller in the press.

6. The improvement in a keyless printing press as claimed in claim 4, wherein said ink delivery nozzle defines an ink delivery port therein through which ink is discharged from the nozzle toward said ink source roller, and said refresh doctor is disposed immediately upstream of said ink delivery port with respect to the direction of rotation of said ink source roller in the press.

* * * * *